US006125612A

United States Patent [19]

Main

[11] Patent Number: 6,125,612

[45] Date of Patent: Oct. 3, 2000

[54] METHOD OF STRETCH WRAPPING HEAVY COILS

[75] Inventor: Kenneth G. Main, Maryville, Tenn.

[73] Assignee: Aluminum Company of America, Pitttsburgh, Pa.

[21] Appl. No.: 09/325,439

[22] Filed: Jun. 3, 1999

Related U.S. Application Data

[63] Continuation of application No. 09/067,582, Apr. 28, 1998, Pat. No. 5,918,745.

[51] Int. Cl.[7] ..... B65B 61/00; B65B 61/22

[52] U.S. Cl. ..... 53/415; 53/399; 53/409; 53/449

[58] Field of Search ..... 53/409, 416, 449, 53/459, 455, 452, 461, 457, 415, 400, 401, 402; 206/303, 386, 410, 597, 600, 389, 413; 108/55.1, 55.3

[56] References Cited

U.S. PATENT DOCUMENTS

| | | | |
|---|---|---|---|
| 4,013,168 | 3/1977 | Bamburg et al. | 206/598 |
| 4,694,962 | 9/1987 | Taub | 206/600 |
| 4,928,454 | 5/1990 | Bertolotti | 53/409 |
| 5,092,464 | 3/1992 | Taylor et al. | 206/408 |
| 5,365,859 | 11/1994 | Slocumb | 206/597 |
| 5,450,965 | 9/1995 | Cox | 206/597 |
| 5,515,973 | 5/1996 | Sharp | 206/497 |
| 5,752,362 | 5/1998 | Eichbauer | 53/399 |
| 5,941,050 | 8/1999 | Geogetti et al. | 53/399 |
| 5,950,400 | 9/1999 | Callahan | 53/410 |

*Primary Examiner*—Peter Vo
*Assistant Examiner*—Hemant M. Desai
*Attorney, Agent, or Firm*—David W. Brownlee; Edward L. Levine

[57] ABSTRACT

A stretch wrapped and roped package for heavy loads such as cylindrical coils of metal, paper or the like that includes a skid supporting the load. A friction layer on the top of the skid and another friction layer on the bottom of the load which is covered by an overwrap of protective material such as plastic or paper. The skid is especially designed to reduce risk of damage to the stretch wrap roping that holds the skid onto the bottom of the load.

11 Claims, 3 Drawing Sheets

METHOD OF STRETCH WRAPPING HEAVY COILS

This is a continuation application of U.S. Ser. No. 09/067,582 filed Apr. 28, 1998 now U.S. Pat. No. 5,918,745.

BACKGROUND OF THE INVENTION

1. Field of the Invention

This invention relates to packaging for heavy coils of strip material, and in particular to a packaging system that includes a skid supporting a heavy coil of strip material and stretch wrap plastic roped around the base of the coil and the corners of the skid. The package includes means for increasing the friction between the coil and the skid and preferably includes means for reducing damage to the stretch wrap material and the coil during transport.

2. Description of the Prior Art

Heavy cylindrical coils of strip material, such as aluminum, steel, paper and the like, are typically shipped by truck, rail and/or ship from the manufacturer of the coils to their users. Many of such coils may each weigh several thousand pounds. For example, a coil of aluminum strip material may weigh 30,000 pounds. The coils are usually covered with an outer packaging material such as plastic or paper to protect them from dirt and moisture.

To provide for transport by fork truck, truck, rail and overseas ship, the coils are rotated 90 degrees, resulting in the coil orientation being center axis vertical, and set on a pallet or skid. Typically, the skid is attached to the coil/load by means of vertical strapping (i.e., steel bands, plastic bands, web type bands) to keep the skid underneath its load during movements (i.e., shifts, impacts, vibration). The strapping nominally wraps underneath the center skid runner, up the front side of the load, across the top of the load (front-to-back), and down the back side of the load. A second strap wraps underneath and through the front-to-back center of the skid from right to left, up the left side of the load, across the top of the load (left-to-right), crossing the first strap, and down the right side of the load. Even with significant tension in the strapping material there is movement at the interface between the load and the skid. Movement at this interface, where there is load bottom packaging material between the load and the skid, abrades or wears on the load bottom packaging material.

Today's packages have countered abrasion on the bottom of the coil through increased layers of load bottom packaging material to minimize wear through over long distance transits. Also, the abrasion has been countered through various layers of padded material between the load bottom packaging material and the skid top. This is used in conjunction with the strapping tension to provide a means of grabbing the leading load edges and the skid deck board edges to keep the skid with its load. With enough load bottom packaging material and with enough pad thickness for typical hard impacts and/or long distance transit vibrations, these packages minimize packaging wear through and minimize the load-to-skid movements, making successful and reliable packaging systems. In an effort to reduce ergonomic health and safety packaging materials application issues and to reduce packaging materials for recycling, waste stream and cost benefits, a technology of stretch wrap roping is sometimes employed. Stretch wrap roping is stretch film pre-stretched, its width necked down into a small diameter rope, and tightly applied around the skid and its load. Since this rope is applied in a circular motion around the load and skid in the same approximate plane as the top of the skid, there is little securement of the skid vertically to the load. During transit of the stretch wrapped load, vertical movement of the package by fork truck hauling, rail car impact and the like sometimes results in vertical separation of the skid from the coil. The skid under compression pushes away from its load when the package is above the transit load surface. During this time of separation, any horizontal force against the skid or load separately will cause load-to-skid movement. As the load begins to again come in contact with the skid, which may now have different horizontal speeds, there is rubbing of the load bottom packaging material to the skid pad or rubbing of the load bottom packaging material against the load. Both of these are causes of packaging material abrasions. Also, during horizontal transit, impacts occur when the transit equipment suddenly slows or stops and the load is allowed to partially move in relation to the transit equipment. There is likewise load-to-skid movement and abrasion damage if the friction at the interface between the skid and transit load surface is greater than the friction at the interface between the load and skid. To successfully employ the stretch wrap roping packaging method, load-to-skid movements that result in load bottom packaging material abrasion wear through must be eliminated or significantly minimized.

Several different external events can damage the ropes in a stretch wrapped package. For example, non-level lifting of the skid load by a fork truck where the forks are tilted forward can damage the ropes when the skid load is initially lifted by the backs of the forks raising the first skid deck board away from its skid runners. This happens because the heavy load holds the rest of the skid flat against the floor surface. This uneven lift can lift the first deck board away from its runners as much as two inches before the rest of the load weight is captured by the front end of the forks. It can also break or bend the first deck board one to two inches back across its full left-to-right width. Stretch wrap roping wrapped around the corners of the first and last skid deck boards would become loose, pop over the deck board corners or be cut by severe deck board breakage, reducing or eliminating any rope tension needed for the package requirements.

Damage also occurs to stretch wrap roping when they are subjected to knife like actions from the normal sharp 90 degrees skid corners during transport movements. This can cut some or all of the ropes wrapped around a skid corner, reducing or eliminating any rope tension needed for the package requirements.

Damage to stretch wrap roping also occurs due to compressing and cutting of the ropes. The ropes are wrapped around the corners of skids and pass over the front and back faces of the skid runner and the front and back edges of the skid deck board. When skid loads are warehoused, stored or transported, two skids can be butted against one another, compressing or crushing the ropes passing across the front/back skid end faces. This can cut some or all of the ropes wrapped across the skid end faces, reducing or eliminating any rope tension needed for the package requirements.

The forks on fork lift trucks can also damage the stretch wrap roping. The ropes are typically wrapped around the corners of the skid runners and pass over the front and back edges of the skid deck board. The ropes pass across a void between the two skid faces that begins at the inside edge of the skid runner front face, crosses the void, and ends at the bottom edge of the skid deck board front face. This void, below the skid deck boards and inside the outside skid runners, is where the forks of fork trucks enter to lift the skid load. As these forks move in or out at the corner, where the ropes cross the void, the ropes rub across the top outside corners of the forks. This can cut some or all of the ropes in a skid corner void, reducing or eliminating any rope tension needed for the package requirement.

Accordingly, there is a need for an improved stretch wrapped coil/load package that reduces the vulnerability of such package to damage during transit and/or storage of the package.

SUMMARY OF THE INVENTION

This invention provides a stretch wrapped package that keeps a skid directly beneath the load during typical transport. The invention employs stretch wrap roping packaging technology to be able to take advantage of reduced ergonomic health and safety packaging materials application issues and reduced packaging materials for recycling, waste stream and corresponding cost benefits, and overcomes or counteracts the problem inherent in stretch wrap roping packaging technology historical shortcoming of providing little vertical securing of the skid to its load. This invention maintains the skid directly beneath the load resulting in no significant load-to-skid relative motion and minimal load bottom packaging material abrasion wear. This invention provides increased friction between material layers and stretch wrap roping and essentially eliminates movement between the load and the skid. This invention thereby inhibits damage to the bottom of the load from abrasion and other physical marking, and exposure to moisture and dirt effects. This invention also reduces damage to the stretch wrap rope that could result in reduced package integrity.

This invention provides a layer of low density plastic film material, having a high coefficient of friction (COF), on the surface of a skid and a similar layer of low density plastic film on the bottom of the load. A vapor wrap covers the load and the plastic film on the bottom of the load, which is the bottom load packaging material. All layers of plastic film inhibit horizontal movement between the load and the skid so as to greatly reduce the possibility of abrasion damage to the load bottom and the bottom load packaging material (vapor wrap). The package has a skid wrap of stretch wrap film roped around the bottom of the load and the corners of the skid.

The skid in a package of this invention has recessed and rounded corners and notches in ends of the outer runners of the skid for receiving the skid wrap so the skid wrap is less likely to be damaged during transport or warehousing. The skid also preferably has fork guards on the underside of the skid deck to protect the ropes from being damaged by the forks on a forklift truck. Damage to the skid wrap is detrimental to package integrity because the damage weakens or destroys the ropes that hold the skid to the load.

It is the primary object of this invention to provide an improved stretch wrapped packaged that has improved resistance to load damage and improved package integrity.

A further object is to provide a heavy load package that provides ergonomic health and safety packaging material benefits and reduced packaging materials for recycling, waste stream and cost benefits.

Another object is to provide a packaged coil which reduces manpower requirements and costs.

A further object of this invention is to provide a packaging system for heavy loads having reduced risk of movement between the load and the skid on which the load is supported.

The above and other objects and advantages of this invention will be more fully understood and appreciated with reference to the attached drawings and the following description of the invention.

DESCRIPTION OF THE PREFERRED EMBODIMENTS

Figure 1:
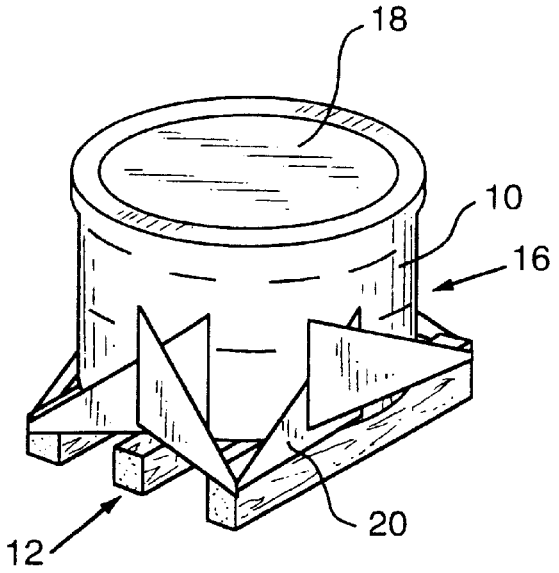
FIG. 1 is a perspective view of a stretch wrapped package of this invention.

In order to understand and appreciate this invention, it is helpful to understand the four different states of relative movement between a load and a skid at the load-to-skid interface while a package of this invention is being transported. The four different states are (1) sliding, (2) transitional, (3) dragging and (4) flying. The relative movement that creates the different states can be initiated by several events. For example, a fork truck transporting a package may be moving in a given direction when the truck falls into a hole in the floor, causing the package to vertically separate from the forks of the truck. Then abruptly the truck hits the back side of the hole causing the truck to decelerate, resulting in relative movement between the load and the forks. Another event that causes this type of relative movement is during rail car impacts (i.e., humping). During such rail car impacts, the cars are designed to convert some of the horizontal impact force into a downwardly directed force to keep the rail car attached to its wheel trucks. This downward force and movement causes the loads to fly and move at different horizontal speeds relative to the rail car.

The sliding state occurs when the horizontal friction force at each interface between the load, skid and all employed packaging materials in the package is greater than the horizontal friction force between the skid bottom and the contacting deck or top surface of the transport means. This state ranges from the full weight of the load imposed on the friction layers to a point where the load vertically begins to separate from the skid and all of the packaging materials and the two horizontal frictional forces become equal. The spring-like, vertical compression force of the skid, compression of uneven skid deck boards and runners, is much less than total of the gravitational force from the weight of the load on top of the skid and the vertical component of the tension forces of the stretch wrap ropes attached to the four corners of the skid and the load. As the load moves vertically away from the deck surface of the transport means and its skid, the end of this state is at the point where the compression force of the skid equals the total of the gravitational force of the load and the vertical rope tension. The horizontal frictional forces in the packaging layers must be greater than the horizontal frictional forces at the bottom skid to keep the skid under its load by pushing the skid across the transport method deck surface with the resultant positive differential frictional force relative to the direction of the load movement.

The transitional state occurs when the above described resultant differential frictional force becomes negative relative to the direction of the load movement and with neither of the horizontal frictional forces equal to zero. This occurs as the load continues vertically to separate from its skid and packaging materials but still not lose contact. Also, the horizontal component of the tension forces of the stretch wrap ropes between the load and the two skid corners opposite the direction of the load movement are greater than the negative resultant differential frictional force. The net resultant horizontal force of all the frictional forces and the stretch wrap rope forces is positive, still keeping the skid under its load by pushing and pulling the skid across the transport method deck surface. This state ranges from the resultant horizontal differential frictional forces equaling zero to the point where there is no longer any load-to-skid horizontal frictional forces; the load begins actual physical separation from the skid and packaging materials. Additionally, the vertical compression force of the skid is now greater than the total of any remaining gravitational force of the load against the skid and the vertical stretch wrap ropes tension. At the end of this state the vertical compression force and the remaining gravitational force of the load against the skid have gone to zero, while the tension forces in the vertical component of the stretch wrap ropes is offset by the larger gravitational force of the skid weight.

The dragging state occurs when there is no load-to-skid horizontal frictional forces and only skid bottom horizontal frictional forces pulling negatively in the direction of the load movement. Otherwise, the skid is wanting to drag behind the movement of its load. However, the horizontal component of the tension forces of the stretch wrap ropes between the load and the two skid corners opposite the direction of the load movement are greater than the negative dragging frictional force. The net resultant horizontal force of the dragging force and the rope tension forces is positive still keeping the skid under its load by pulling the skid across the transport method deck surface. This state ranges from the point where the only horizontal frictional force is the skid dragging on the transport method deck and the load-to-skid horizontal frictional forces have just gone to zero to the point where the horizontal skid dragging frictional force goes to zero as the load continues to vertically move from the transport method deck surface. Additionally, the vertical component of the stretch wrap ropes tension continues to be offset by the larger gravitational force of the skid weight. As the load continues to move vertically away from the transport method deck surface the vertical component of the stretch wrap ropes tension increases with the angular change of the ropes relative to the load. At the end of this state the vertical rope tension forces are equal to the gravitational forces of the skid weight as the skid now begins to physically separate from the transport method deck surface. The load is physically flying while dragging its skid across the transport method deck surface during this state.

The flying state occurs when there are no horizontal frictional forces and any externally applied horizontal forces on the skid are offset by the greater horizontal component of the stretch wrap ropes tension forces between the load and the two skid corners opposite the direction of the load movement. Additionally, the vertical component of the stretch wrap rope tension forces are equal to the gravitational forces of the skid weight. The total package is physically flying above the transport deck surface during this state.

Figure 2:
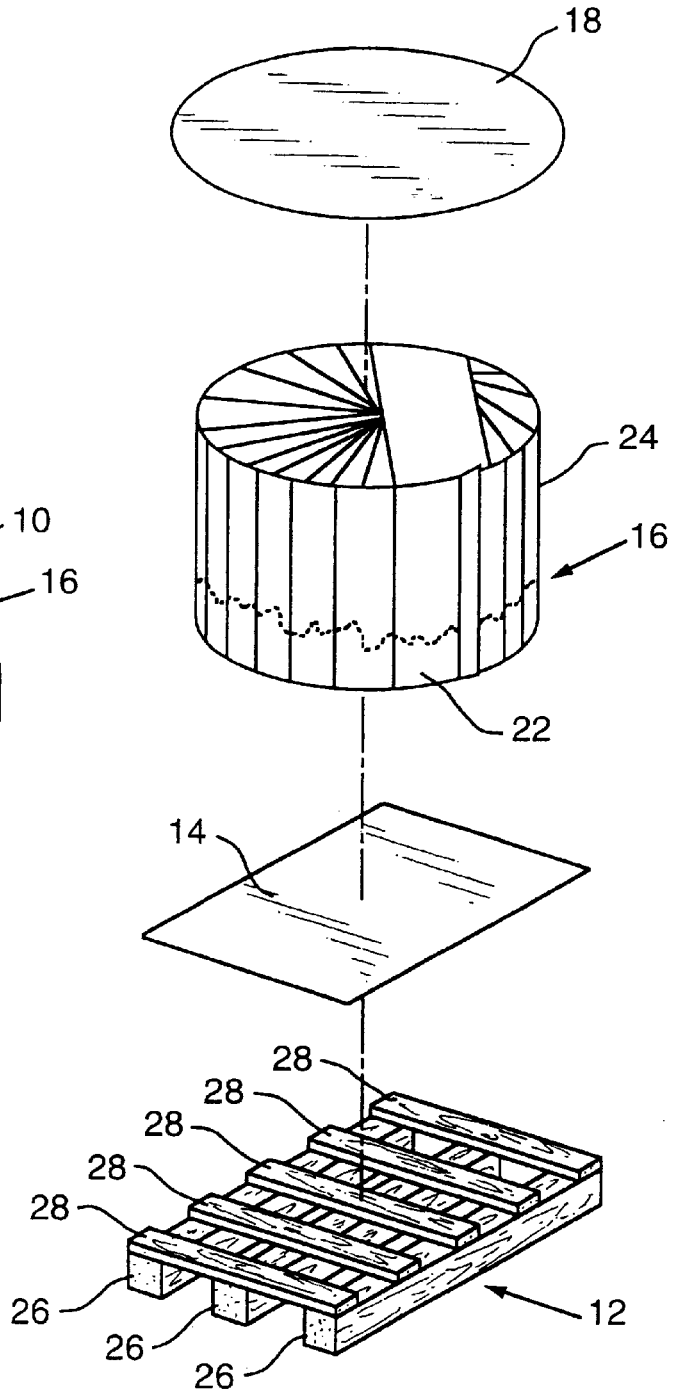
FIG. 2 is an exploded view of the components to a preferred embodiment of a stretch wrapped package of this invention.

Turning now to the drawings, FIGS. 1 and 2 illustrate a preferred embodiment of a package 10 of this invention that is especially suitable for transporting heavy loads such as coils of aluminum, steel and paper. The package 10 employs stretch wrap roping 20 to reduce packaging materials that would end up as waste, and thereby reduces packaging cost. The package includes a skid 12 that is preferably made of oak boards, a friction layer 14 of low density, high COF plastic film on the skid, a coil 16 of material to be transported, a "pizza" top 18 on the coil, and skid wrap 20 around the lower portion of the coil and around the corners of the skid. The coil 16 has an abrasion resistant layer 22 of low density, high COF plastic film disposed against its bottom and against the lower base of the coil. It has an outer vapor wrap 24 of plastic sheet material covering the entire coil 16 including the abrasion resistant layer 22.

The skid 12 must be capable of supporting the full weight of the heavy load either on its runners 26 while the package is sitting on a floor surface or on its deck boards 28 while the package is being transported with a fork truck. Typically, the deck surface of the transport vehicle or ship is a steel plate having an upper surface that may or may not be painted. The coefficient of friction between oak skid runners 26 and a rail car that has a worn painted floor surface is typically about 0.5 to 0.55. This coefficient of friction must be less than the coefficient of friction between the load and the skid in order for the layers to properly function in the sliding and transition states.

The friction layer 14 on the skid 12 is preferably a thick, low density, high COF polyurethane film, preferably containing high tackifier and no blocking agents, which is adhered to a fabric based pad. One embodiment of a package of this invention uses a friction layer containing 71 g/ft$^2$ shoddy pad (pad made of ground-up rags) with a 9 mil high COF polyurethane top layer on the pad. The top layer of polyurethane is preferably at least about 0.007 inch thick and more preferably about 0.009 inch thick. This layer provides two functions. The first function is that the pad must directly interface with the top of the skid deck boards to provide a high coefficient of friction that is needed for the sliding and transition states. The pad grabs the roughness of the wood skid deck boards 28 and grabs the leading edges of the deck boards due to its bulk, providing a primary function of this package layer. The coefficient of friction measured at this interface is preferably greater than about 1.5. Without a pad layer, the low density polyurethane film molds itself to the grain and edges of the skid deck boards to provide a rough surface between these two layers. With the addition of the high tackifier and the no blocking agents in the film, the coefficient of friction of the interlayer measured at 0.81, still a good level needed for the sliding and transition states.

A second optional function is to keep skid abnormalities (i.e., raised nail heads, large wood splinters from skid deck boards) from puncturing the outer vapor wrap, the bottom load packaging material, and from marking the bottom surface of the load (pad function). If there are no skid abnormalities, the pad function is not needed and only the poly film is required.

The abrasive resistant layer 22 on the bottom of the coil 16 is also preferably thick, low density, high COF polyurethane film with high tackifier and no blocking agents. This layer also preferably provides two functions. The first function is the abrasion resistant function to keep the load 16 from cutting or chopping its way through into the protective outer package vapor wrap material 24. The combination of the thickness of the film and the low density characteristic of being more tolerant to tears and cuts provides the needed abrasion resistant function. Additionally, the low density of the layer 22 provides a form fitting feature that molds itself to the bottom configuration of the load 16, providing an interface layer with a very high coefficient of friction needed for the sliding and transition states. The high tackifier blended into the film and the absence of blocking agents, which are normally used to make film more slippery, provide a surface with a high coefficient of friction. The bottom surface of this layer 22 is used in conjunction with the outer vapor wrap layer 24 to provide an interface with a high coefficient of friction needed for the sliding and transition states. One example of such a layer is 9 mil high COF polyurethane (50% fleximar, 50% EVA base with 5% tackifiers).

The outer vapor wrap 24 is preferably a stretch film whose main purpose is to functionally protect the load against from moisture, dirt and dust. To assist in helping the other bottom package layers to protect this outer vapor wrap layer 24, the outer vapor wrap material must also have a high coefficient of friction capability to interact with adjacent layers above and below the outer vapor wrap. For this invention, the stretch film used as an outer vapor wrap 24 may have tackifiers added to its blend to provide a high coefficient of friction. The top surface of the bottom outer vapor wrap 24 is used in conjunction with the bottom of the abrasive resistant layer 22. The high coefficient of friction at this interface has been measured to be greater than 1.84 which is needed for the sliding and transition states. Likewise, the bottom surface of the bottom outer wrap is used in conjunction with the top surface of the friction deck method with a very high coefficient of friction needed for the sliding and transition states. An example of an outer vapor wrap includes 150 gauge, blown film, 50% pre-stretched, with a heavy tackifier, applied in five layers thick.

The skid wrap 20 is preferably stretch wrap film that has been roped and wrapped alternatively between a skid corner and the lower body of the load 16 for several ropes per corner. The design of the stretch film characteristics such as gauge, strength and elongation, the number of ropes used per skid corner, and the rope application force are determined to meet the tension requirements for the transition state of the package. The film is pre-stretched and applied in a circular motion around the outer vapor wrap 24 on the coil 16 and the skid 12. The film is necked down in width into a small diameter rope that is tightly wrapped around the corners of the skid. A total accumulative tension of about 750 lbs. is preferably applied to the wrap at the corner of the skid.

The "pizza" top 18 is preferably a disc of corrugated paperboard or outer resiliently compressible material to protect the top of the coil. A typical pizza top may be made of 250 lb. test corrugated paperboard and is enclosed within the skid wrap 20 over the coil 16.

Figure 3:
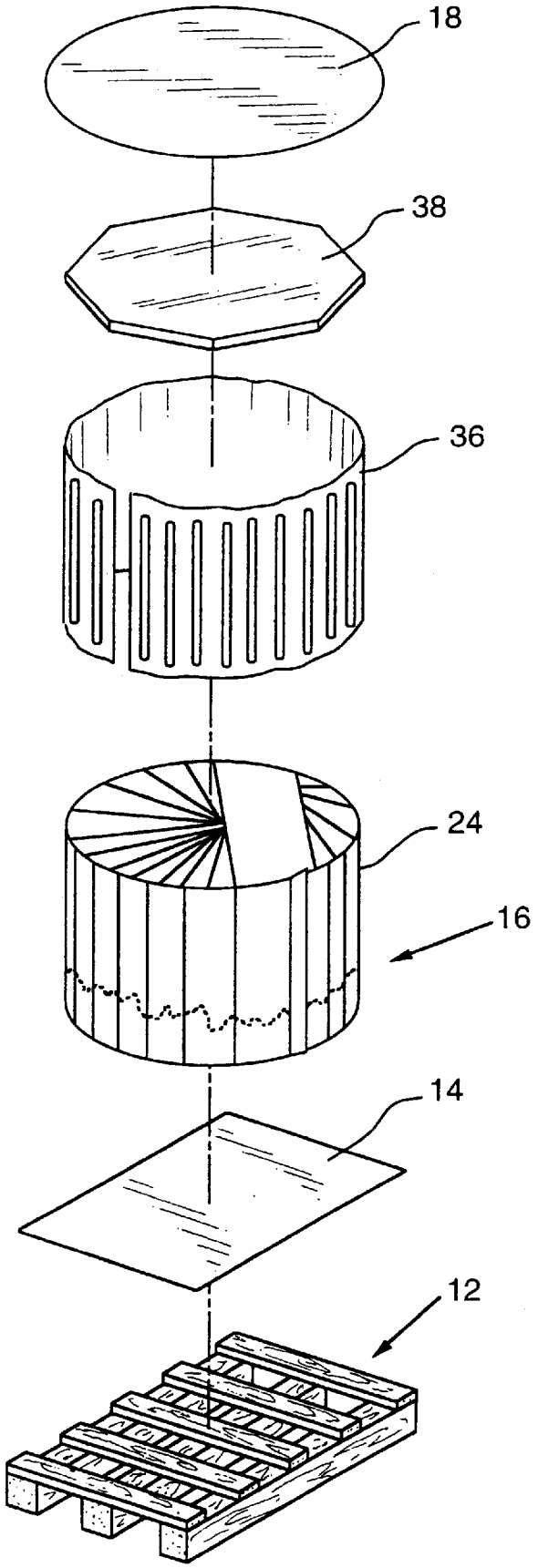
FIG. 3 is an exploded view of the components of an alternative embodiment of a package of this invention.
Figure 6:
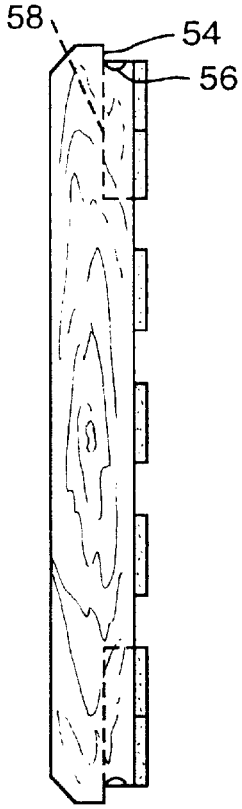
FIG. 6 is a side elevation of the skid of FIG. 4.
Figure 4:
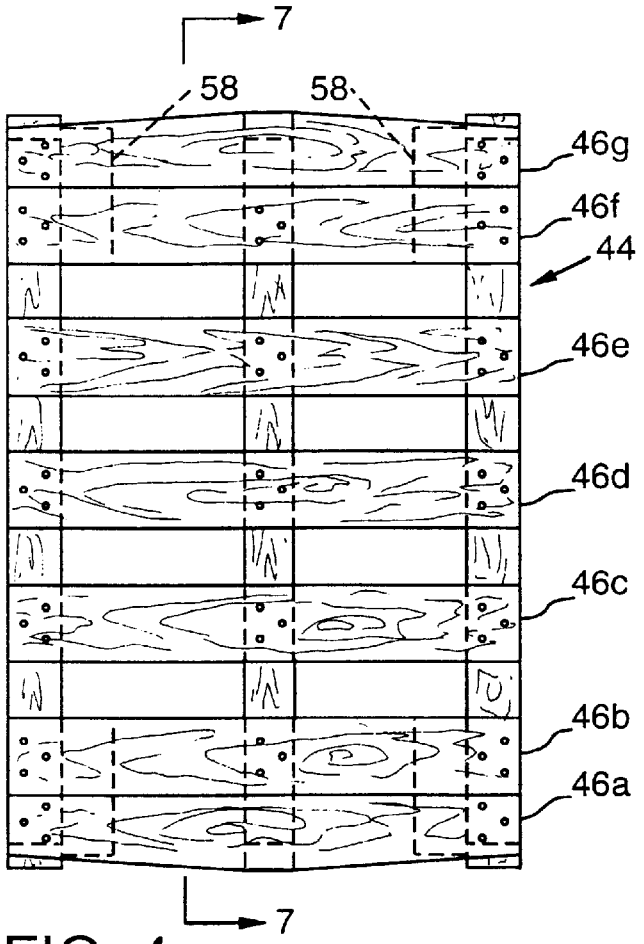
FIG. 4 is a top plan view of a preferred skid suitable for use in a load packaging system of this invention.
Figure 7:
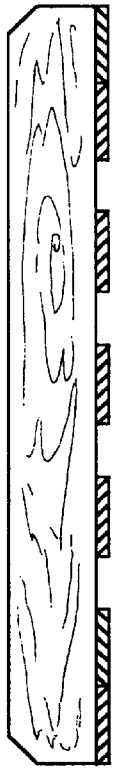
FIG. 7 is a cross-section through the skid of FIG. 4 taken along line 7—7.
Figure 5:
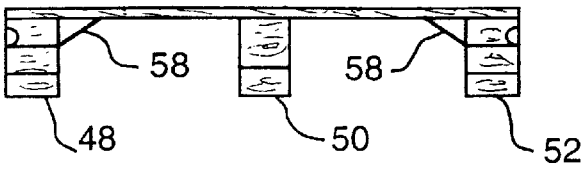
FIG. 5 is an end elevational view of the skid of FIG. 4.
Figure 8:
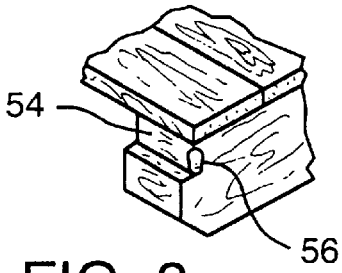
FIG. 8 is a fragmentary perspective view of one corner of the skid of FIGS. 4–7.

FIG. 3 shows the components of an alternative embodiment of this invention, for extraordinary material handling requirements, that includes an outer cylinder 36 of protective material around the coil and the outer vapor wrap 24 and another disc of protective material 38 between the top of the coil 16 and the pizza top 18. The outer cylinder 36 may comprise a variety of materials such as Flex-Pak (Cal-Pac) or chestnut board (chipboard) and the disc may be made of Cascade board (presswood).

FIGS. 4–8 show a preferred embodiment of an oak board skid 44 that is especially designed for use in the present invention. The skid 44 has a deck formed by several deck boards 46*a, b, c, d, e, f* and *g* and at least three runners 48, 50, 52 supporting the boards. The boards 46 are preferably nailed or bolted on the runners to form a rigid, durable skid capable of supporting a heavy coil that may weigh several thousand pounds.

It is a feature of this invention that a skid 44 is designed to reduce risk of damage to the stretch wrapped ropes in a coil package. Skids having oak boards and runners are well known in the art. However, stretch wrapped packages using conventional skids are vulnerable to damage from a variety of external events wherein the ropes that hold the coil on the skid are crushed or cut, thereby reducing or completely losing their effectiveness. A skid of this invention, the first and last deck boards 46*a* and *g* are tapered back from the center of the boards so the ropes around the corners of the two outside runners 48 and 52 and are not disposed around the ends of the deck boards. This recessing substantially eliminates crush zones on the front faces of the outside runners 48, 52 and the front edges of the first and last deck boards 46*a,* 46*g*. Both ends of the two outside runners 48 and 52 also preferably have notches 54 in them and rounded corners 56 so ropes around the ends of the runners fit in rounded recesses and much less likely to be damaged by transit motion or warehousing placement. Each of the rounded corners 56 preferably has about a 1-½ inch diameter at a 45 degree angle to the corner of the skid runners. Thus, the ropes 20 (in FIG. 1) going across each corner is disposed at approximately 135 degrees to the rope around the bottom of the coil 16, which is enough to round the corner, thus keeping the ropes from being cut during transport movement impacts and vibrations.

Fork guards 58 are also preferably secured under the deck boards on the skid at the four corners of the skid to help shield the rope 20 (FIG. 1) against being damaged by the forks on a fork lift truck. The fork guards 58 are under two boards 46*a, b, f, g* on both ends of the deck adjacent the outside runners 48 and 52.

It is therefore seen that this invention provides an improved package for heavy loads/coils in the combination of properly chosen packaging materials and their assembly to provide a total system that allows the package to perform with no or insignificant load-to-skid movement through the imposed dynamics of the four load-to-skid interface states and substantially enhanced package integrity and reduced risk of damage to the stretch wrapped ropes. The package has coefficients of friction at each of the interface layers of the load, skid and all employed packaging materials between the load and skid that is greater than the coefficient of friction between the bottom skid runner material and the surface of the transport means.

A preferred embodiment of this invention has been selected for purposes of illustration and description. It will be apparent to those skilled in the art that numerous variations can be made to such preferred embodiment without departing from the spirit of the invention or the scope of the claims appended hereto. For example, this invention can be used to package a great variety of objects and materials other than coils of strip material. Any heavy product that is vulnerable to damage from relative movement between the product and the skid can benefit by use of this invention. The skid in a package of this invention can be made of a variety of materials, provided the skid has sufficient strength and coefficients of friction required for this invention.

What is claimed is:

1. A method of wrapping a heavy load, comprising:

providing a skid suitable for supporting said heavy load, said skid having corners and an upper surface;

providing on said skid upper surface a friction layer of a high COF material;

providing against the bottom of said load a load abrasion resistant layer of a high COF material;

providing about said load and said load abrasion resistant layer an outer vapor wrap of a high COF material;

providing wrapped about at least a lower portion of said load and roped about said corners of said skid, a plastic film, to prepare a wrapped package; and placing said wrapped package on a surface of a transport vehicle wherein said placing step includes placing said wrapped package on a surface of a transport vehicle having a COF at the interface between said transport vehicle surface and said wrapped package which is less than the COF between each of (a) said load and said load abrasion resistant layer, (b) said load abrasion resistant layer and said outer vapor wrap, (c) said outer vapor wrap and said friction layer, and (d) said friction layer and said skid upper surface.

2. The method of claim 1 further comprising providing about said outer vapor wrap an outer cylinder.

3. The method of claim 1 further comprising providing atop said outer vapor wrap a disc of protective material.

4. A method of transporting a heavy load comprising:

providing a skid suitable for supporting said heavy load, said skid having corners and an upper surface;

providing on said skid upper surface a friction layer of a high COF material;

providing against the bottom of said load a load abrasion resistant layer of a high COF material;

providing about said load and said load abrasion resistant layer an outer vapor wrap of a high COF material;

providing wrapped about at least a lower portion of said load and roped about said corners of said skid, a plastic film, to prepare a wrapped package; and placing said wrapped package on a surface of a transport vehicle wherein said placing step includes placing said wrapped package on a surface of a transport vehicle having a COF at the interface between said transport vehicle surface and said wrapped package which is less than the COF at each interface between said load and said skid upper surface.

5. The method of claim 4 further comprising providing about said outer vapor wrap an outer cylinder.

6. The method of claim 4 further comprising providing atop said outer vapor wrap a disc of protective material.

7. The method of claim 5 further comprising providing atop said outer vapor wrap a disc of protective material.

8. A method of moving a heavy load, comprising:

providing a skid suitable for supporting said heavy load, said skid having corners and an upper surface;

providing on said skid upper surface a friction layer of a high COF material;

providing against the bottom of said load a load abrasion resistant layer of a high COF material;

providing about said load and said load abrasion resistant layer an outer vapor wrap of a high COF material; and providing wrapped about at least a lower portion of said load and roped about said corners of said skid, a plastic film, to prepare a wrapped package; and then lifting said wrapped package with a fork lift wherein the COF at the interface between said fork lift and said wrapped package is less than the COF at each interface between said load and said skid upper surface.

9. The method of claim 8 further comprising providing about said outer vapor wrap an outer cylinder.

10. The method of claim 8 further comprising providing atop said outer vapor wrap a disc of protective material.

11. A method of moving a heavy load, comprising:

providing a skid suitable for supporting said heavy load, said skid having corners and an upper surface;

providing between said load and said skid upper surface one or more layers of a high COF material;

providing wrapped about at least a lower portion of said load and roped about said corners of said skid, a plastic film, to prepare a wrapped package;

placing said wrapped package on a surface of a transport vehicle wherein the COF at the interface between said surface of said transport vehicle and said wrapped package is less than the COF at each interface between said load, said one or more layers, and said skid upper surface.

* * * * *